United States Patent [19]

Hofbauer et al.

[11] 4,234,206

[45] Nov. 18, 1980

[54] SKI BRAKE

[75] Inventors: Rupert Hofbauer, Schwechat; Friedrich Leichtfried, Traiskirchen; Josef Svoboda, Schwechat, all of Austria

[73] Assignee: TMC Corporation, Baar, Switzerland

[21] Appl. No.: 932,789

[22] Filed: Aug. 11, 1978

[30] Foreign Application Priority Data

Aug. 18, 1977 [AT] Austria ..... 5956/77
Nov. 3, 1977 [AT] Austria ..... 7829/77

[51] Int. Cl.[3] ..... A63C 7/10
[52] U.S. Cl. ..... 280/605
[58] Field of Search ..... 280/604, 605

[56] References Cited

U.S. PATENT DOCUMENTS

| | | | |
|---|---|---|---|
| 3,989,271 | 11/1976 | Riedel | 280/605 |
| 4,014,563 | 3/1977 | Weigl et al. | 280/605 |
| 4,124,223 | 11/1978 | Kubelka | 280/605 |

FOREIGN PATENT DOCUMENTS

| | | | |
|---|---|---|---|
| 334800 | 2/1977 | Austria . | |
| 7501378 | 5/1975 | Fed. Rep. of Germany . | |
| 2525945 | 12/1976 | Fed. Rep. of Germany | 280/605 |

*Primary Examiner*—John J. Love
*Assistant Examiner*—Milton L. Smith
*Attorney, Agent, or Firm*—Blanchard, Flynn, Thiel, Boutell & Tanis

[57] ABSTRACT

A ski brake for use on a ski having a mounting structure adapted to be mounted on the ski and a pedal structure pivotally secured to the mounting structure. The pedal structure includes a pair of laterally spaced and elongated guideways opening outwardly in a bottom surface thereof opposing the upper surface of the ski. The guideways each have at least a pair of angled segments. A pair of ski brake arms is pivotally secured to the mounting structure for movement about a universal type pivot joint with the ends remote from the snow engaging ends having angled guide segments received in the respective one of the guideways in the pedal. There is an operative connection between the pedal and the guide segments on the ski brake arms for preventing a separation of these members during use. Resilient structure is provided for continually urging the pedal to an upright position to effect a positioning of the snow engaging ends of the ski brake arms beneath the bottom surface of the ski. The guideways control the movement of the guide segments on the ski brake arms as the pedal is moved against the urging of the resilient structure to effect a positioning of the snow engaging ends of the ski brake arms over the upper surface of the ski when the ski brake is in a retracted position.

17 Claims, 10 Drawing Figures

SKI BRAKE

FIELD OF THE INVENTION

The invention relates to a ski brake having two braking wings or mandrels, which are constructed as two-arm levers which are pivotal about an axle which extends substantially at a right angle with respect to the longitudinal axis of the ski, which braking wings or mandrels each have at one of their free ends a braking spur or the like and can be operated at each of their ends which are opposite the braking spur through an operating means by a pedal and the pedal together with the braking spurs is pivotal toward the upper surface of the ski and the braking wings or mandrels are held by a ski boot which is inserted in a ski binding which is provided on the upper surface of the ski against the force of a spring in a retracted position (rest position) substantially parallel to and above the upper surface of the ski or lying within the edges of the ski and after the release of the ski boot, for example due to a fall of the skier, by means of a force of the spring about the axle in a downhill or rather braking position, the braking spurs project below the running surface of the ski.

BACKGROUND OF THE INVENTION

Such a ski brake is described for example in German OS No. 25 25 945. In this known construction, the axle on which the braking mandrels are arranged pivotally can, viewed in the longitudinal direction of said axle, be telescoped. Bent sections of the two braking mandrels, which extend below the pedal, are connected by means of a pin which can be also telescoped, and which pin is guided in turn in a slotted hole in a bar which is secured on the underside of the pedal, which slotted hole extends substantially parallel to the upper side of the pedal. The pedal has furthermore bars which point in direction toward the upper surface of the ski, which bars are arranged on the two sides of the pedal and have sloped surfaces on their inner sides, which sloped surfaces correspond each with a sloped surface of a cam which is associated with the individual braking mandrels. Furthermore a pressure spring can be utilized, which urges apart the two axial parts and to thus effect a lateral shifting of the braking mandrels as soon as the ski brake is in the braking position, namely the pedal is in the upwardly tilted position.

One disadvantage of this known ski brake lies in that through the closing of the pedal not only a swivelling of the braking mandrels, but also a shifting of the same transversely with respect to the longitudinal axis of the ski is to take place. Such a shifting can occur only when the braking mandrels lie already totally above the upper surface of the ski. Until this position is reached, however, the sloped area of each cam moves along the inner sloped surface of the two side bars of the pedal, so that the pulling-in effect occurs higher than desired. If this is supposed to be helped by the inner sloped surface of the two bars having a slope also extending in longitudinal direction of the ski, then the manufacture of this brake becomes more expensive and only the last sloped area remains in order to effect the so-called pulling in of the two braking mandrels above the upper surface of the ski. This manner of loading is not sufficient in order to be able to effect a fully effective pulling in.

A further disadvantage exists in that the bent sections require with the guide pin and the bar receiving said guide pin a structural height below the pedal, which dimensions increase, due to the here occurring forces, the entire structural height of the pedal in an undesired manner.

Finally it can also not be recognized through which force the pedal is to be swung from the ready or retracted position of the ski brake into the braking position of the latter, because the provided spring effects only a spreading-apart of the two braking mandrels. In the case of a stepped-down pedal with pulled-in braking mandrels, no force is created which would act vertically upwardly from the upper side of the ski. Should for this a separate spring be needed, then it is disadvantageous to use two springs, of which one effects an erecting of the brake and the other spring effects a spreading apart of the two braking mandrels.

Finally a separate axle which is arranged in a ski-fixed mounting is absolutely necessary for supporting the pedal. Disadvantageous is also the relatively great number of structural parts, their design and cooperation which takes place in several planes, which makes this brake not only expensive, but also susceptible to trouble. Since the braking mandrels are pressed by the spring which loads the axle constantly against the associated sloped surface of the relevant bar of the pedal, this contact force acts against the necessary swinging back of the braking mandrels from the ready position into the braking position. In order to be able to overcome this additional force, the erecting spring of the ski brake must be dimensioned stronger. This in turn has the result that the clamped-in ski boot is loaded with a greater force, than is the case in common ski brakes. This in turn has disadvantageous consequences for the release operations of the ski boot (danger of jamming).

If, however, the spring which loads the two axial parts should act also as an erecting spring, then the known solution is not serviceable, because in the stepped-down condition the cooperating sloped surfaces of bar and cam assume a position with one another in which the sloped surface of the cam is pivoted for approximately 90°, so that the sloped surface of the bar comes into contact with the cam of the braking mandrel only along one edge. Since due to the arrangement of the spring between these two sloped surfaces a contact is continuously needed, in the stepped-down condition of the pedal a shifting of the braking mandrels and a swinging of the pedal would have to be caused simultaneously, which movement due to the occurring friction is hardly possible. Thus a ski brake of the known type would remain in the swung-down position (self-locking). Therefore, it is not suited to safely stop a run-away ski.

The purpose of the invention is now to provide a ski brake of the above-mentioned type such that swinging and pulling-in of the braking mandrels takes place without the occurrence of the oppositely acting forces, and thus the use of a spring which produces the erecting force is sufficient. Thus, the inventive ski brake is to have a smaller number of structural parts compared with the conventional construction and these are also to be manufactured simpler. Also the structural height of the ski brake in the ready or retracted position is to be lower.

The set purpose is inventively attained by the axle for the braking wings or mandrels, as actually known, being supported in a ski-fixed holding plate, by each lever arm which extends from the axle in a direction toward the pedal having several bent sections, which are provided at least in the area of each braking wing or mandrel, which area is adjacent to the pedal and the bent sections which are associated with the pedal are arranged in pairs engaging slots which are provided in the underside of the pedal and of these pairs of bent sections, one is positioned substantially perpendicularly to the slot, in which it is guided and the further bent section which is connected to this bent section is arranged extending substantially parallel with respect to the underside of the pedal to guidingly secure the associated braking wing or mandrel against a falling out of the slot which guides said structural part.

Due to the inventive construction of the ski brake, the braking mandrels and also their axle can be manufactured of a wire material, whereby pulling-in is done by the cooperation of the bent areas of the individual braking wings or mandrels and the guideways which are associated therewith and are constructed as slots, which guideways are constructed in the underside of the pedal. The vertical arrangement of the end areas of the bent sections which face the pedal, which end areas act as guide pins with the slot, with which they are associated make a jamming impossible because the width dimension of the slot can be enlarged if necessary in the area in which the jamming could occur the easiest without altering the pulling-in effect. The inventive arrangement permits also a structural height of the entire ski brake which is lower with respect to the known solutions. The braking wings or mandrels will be identified hereinafter for the sake of simplicity only as braking wings or as braking mandrels. A preferable embodiment of the invention consists in the two braking wings being connected through openings which are provided in enlargements of said wings to each bent end of the axle and the enlargements of the braking wings are constructed preferably as shoulders which lie approximately perpendicularly with respect to the longitudinal axis, which shoulders form in the braking position of the ski brake with the bent ends of the axle an approximately right angle. This construction facilitates a specially simple support of the individual braking mandrels on the axle for the purpose of carrying out a swinging to effect a pulling thereof, only the area of the individual braking mandrels which is associated with the axle must be slightly flattened and enlarged.

A further thought of the invention consists in the two braking wings each having triple bent sections and each first bent section, viewed in a direction from the axle toward the pedal is constructed substantially extending at a right angle with respect to the longitudinal axis of the ski, each bent section which follows in the area of the slot is constructed pointing from the plane of the braking wings substantially normally toward the underside of the pedal and each third bent section is constructed extending approximately parallel to every first bent section. As a result, not only a secure guiding of the bent area of the individual braking mandrels, which area acts as a pin, is achieved but these are also secured against a falling out of the slot.

To arrange the spring which loads the ski brake, it is inventively provided that the one end of each spiral spring which swings the two braking wings into the braking position is suspended on the two third bent sections and the two other spring ends are suspended on an axis of rotation which is arranged in a ski-fixed mounting which extends parallel to the axis and lies at a distance from said axis in the ready position of the ski brake on the side which is remote from the pedal, and that the two springs are stored in a cavity of the pedal.

The degree of pulling in is determined by the course of the individual slots. It is inventively provided for this that the two slots starting at their ends which lie closer to the axes are constructed first in straight sections extending parallel with respect to the longitudinal axis of the ski and are subsequently bent toward (outwardly) the two edges of the ski, and that the length of the straight sections of the slots corresponds at least with the length difference, which is determined by the difference between the radius for pivoting the pedal about the axis of rotation which is associated with said pedal, or the two braking wings about the axis which is associated therewith.

According to a different embodiment of the invention, the mounting of the braking mandrels is constructed by the axle having one open eyelet at each of its two end areas, in which eyelets the two braking mandrels are arranged with each one being a conventional, approximately semicircular bend gripped around by the free end zones of the two eyelets and each form in this suspended position a bearing point with the two eyelets about which bearing point they are pivotal, controlled by the bent section of the respective slot, pointing toward the longitudinal direction of the ski or away from same. This construction facilitates a manufacture of the individual braking mandrels exclusively by bending same. By choosing the thickness of the wire material, from which the axle and the individual braking mandrels are made, also the size of the opening of the eyelet and the design of the approximately semicircular bend in the individual braking mandrels, the degree of the pulling in can thereby be determined.

A manner to hereby support the individual braking mandrels consists inventively in that, as is actually known, a pair of blind grooves is mounted on the part of the holding plate which lies remote from the axle, in the areas which are remote from the longitudinal axis of the ski and symmetrically to said longitudinal axis of the ski (on the two sides of the holding plate), and that a bent section of a guide member engages each blind groove, for which the blind groove serves as a guideway in the longitudinal direction of the ski and each guide member is hinged in a conventional manner at its end which is remote from the bent section to the associated braking wing.

A further development of the thought of the invention consists in that both on the individual braking wings and also on the guide members and substantially perpendicularly with respect to these structural parts, fastening pins are arranged for receiving each end of spiral springs which are arranged on said structural parts and which load the braking wings and the guide members in closing direction toward one another. This measure permits at the same time a symmetrical arrangement of two springs, which contributes additionally to an increase in stability of the entire construction.

A further thought of the invention consists in the pedal being hinged to the axis of rotation with the interpositioning of a connecting piece, which connecting piece with its end facing the pedal, is hinged to same by means of a connecting axle which extends through both the connecting piece and also the pedal substantially at a right angle with respect to the longitudinal axis of the ski, and in the connecting piece in the area of its two ends having preferably enlargements which extend perpendicularly with respect to the longitudinal axis of the ski. In this manner the angle for the pedal can be determined, so to speak, independently from the angle of the braking mandrels (both referred to the upper surface of the ski), through which the stepping-in comfort can be increased.

A still further thought of the invention consists in the pedal, as is actually known, being swingable relative to the braking wings or mandrels against the force of a leaf spring, which leaf spring is connected at one end to a ski-fixed fastening plate and at the other end to the pedal and the leaf spring is tensioned in the ready position of the ski brake and is relaxed to a slight amount of tension in the braking position. This design has the advantage that the brake is stabilized by the leaf spring in the direction which extends substantially at a right angle with respect to the longitudinal axis of the ski, without requiring additional guides, and for these separate guideways would be needed. The use of leaf spring permits also a position of the pedal which is independent of the angle of the braking mandrel in relationship to the upper surface of the ski, through which a comfortable stepping in is achieved.

This increased comfort is inventively assured by the underside of the pedal defining in the braking position of the ski brake with the upper surface of the ski or with the upper surface of the holding plate an angle of 15° to 60°, preferably 30° to 45°, in particular 40°, which upper surface is preferably a plane (so-called defining plane) which extends through the centerline of the axle and substantially parallel to the upper surface of the ski.

A particularly simple design of the slots consists advantageously in the grooves being constructed as a negative of an insert, preferably of plastic, which insert is inserted into the side of the pedal, which side faces the upper surface of the ski, and is secured possibly releasably on same or rather in same.

A further thought of the invention consists in the holding plate having a thick part for receiving the axle in the area where the braking mandrels are arranged, which axle is pivotally supported limited up to approximately 90°, preferably approximately at about 60°. The thick part of the holding plate which serves as a bearing, preferably through the eyelets which are provided at the two free ends of the axle act as stops on the holding plate. Through this measure the desired braking position of the braking mandrels can be determined without using an additional stop.

For fastening the leaf spring on a fastening plate and on the pedal various measures can be taken. Also fixing of the fastening plate on the ski can be done in various manners. An advantageous inventive solution is that the leaf spring is fastened, for example riveted, to the fastening plate and/or to the pedal and on sloped surfaces on these structural parts, whereby the angle ($\beta$) of the leaf spring, which is defined with the upper surface of the ski, is larger than the angle ($\alpha$) which is defined by the pedal with the upper surface of the ski or with the upper surface of the holding plate or with the determining plane. In this type of fastening, the leaf spring may have a design extending in one single plane.

A modification of the type of fastening of the leaf spring consists inventively in the leaf spring being inserted in the fastening plate and/or in the pedal and having at least in the area of the fastening plate a bend, which angle ($\alpha$) is the complementary angle to 180° of the angle ($\alpha$) which is defined by the leaf spring with the upper surface of the ski or with the upper surface of the base plate or with the determining plane. Through this design of the leaf spring, the initial tension of the same can be determined by the different slope of leaf springs or pedal and braking mandrels. This construction permits furthermore an inserting of the two free ends of the leaf spring into the fastening plate or into the pedal, which facilitates a parallel arrangement of this end area with respect to the upper and undersides of said holding parts. In this manner, fastening can occur by using increased frictional forces for example through an adhesive.

An inventive type of construction of the holding plate consists in the fastening plate for the leaf spring being constructed as a part of the holding plate which supports the ski-fixed axle of the braking mandrels. A different type of construction of the fastening plate consists in the fastening plate for the leaf spring being an attachment on the holding plate. The first mentioned type of construction of the fastening plate has the advantage that for fixing the fastening plate to the ski or to the holding plate no separate holding means are needed. The second embodiment, however, has the advantage that the position of the fastening plate in reference to the holding plate can be adjusted in the longitudinal direction of the ski, which permits the stepping-in angle of the pedal or the spacing of the area of the leaf spring which functions as a swivel axis for the pedal, from the axis of the braking mandrels, to be varied. Both types of construction of the fastening plate can be used for the aforedescribed types of the leaf spring; however, one will use the fastening plate which is constructed in one piece with the holding plate rather for a leaf spring which lies in one plane and the fastening plate which is constructed as an attachment for the leaf spring which has at least one bend therein.

BRIEF DESCRIPTION OF THE DRAWINGS

Further characteristics, advantages and details of the inventive ski brake will now be described more in detail with reference to the drawings, which illustrate four exemplary embodiments.

In the drawings:

FIGS. 1 to 3 illustrate a first exemplary embodiment, wherein FIG. 1 is a side view, FIG. 2 is a top view, both in the braking position of the ski brake, and FIG. 3 is a top view similar to FIG. 2, however, in the retracted position of the ski brake, FIGS. 4 to 6 illustrate a second exemplary embodiment, wherein FIGS. 4 and 5 are associated views of a different ski brake similar to FIG. 1 or 2 and FIG. 6 is a top view of said ski brake similar to FIG. 3, FIGS. 7 to 9 illustrate a third exemplary embodiment, wherein

DETAILED DESCRIPTION

Figure 1:
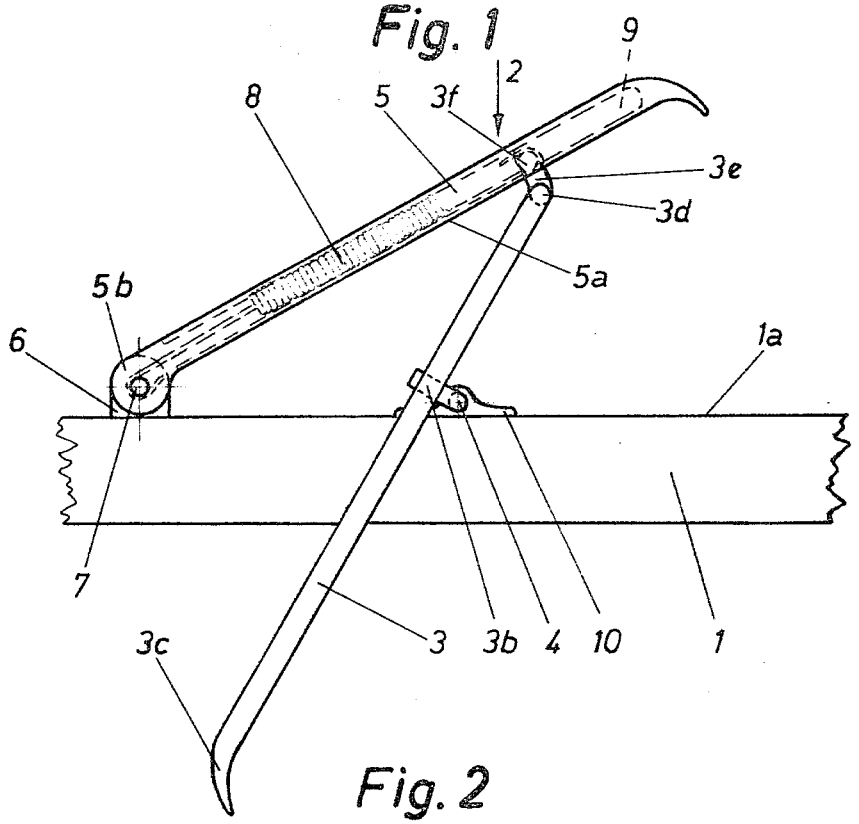
Figure 2:
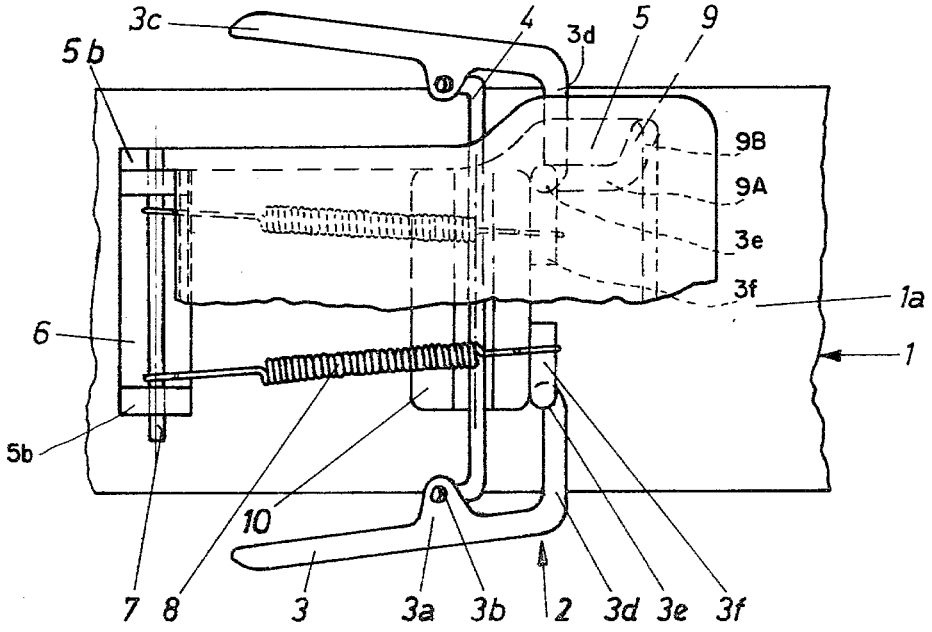
Figure 3:
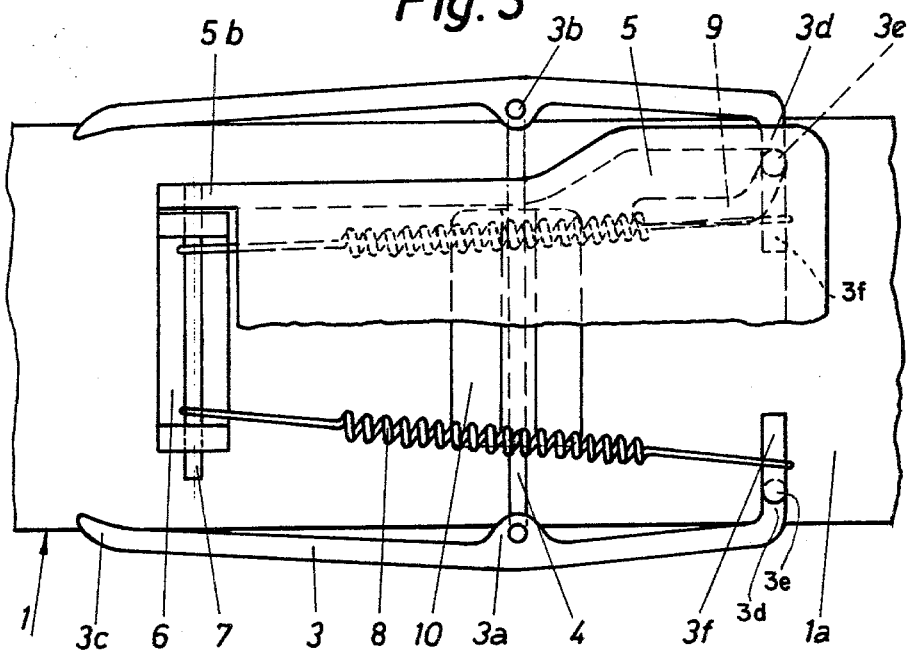

A ski brake which is identified as a whole by the reference numeral 2 can be recognized in the first exemplary embodiment according to FIGS. 1 to 3 on the upper surface 1*a* of a ski 1. The ski brake has braking wings or rather mandrels, which are secured to an axle 4 which extends perpendicular with respect to the longitudinal axis of the ski and is pivotally supported in a ski-fixed holding plate 10. For this purpose, the braking wings 3 have enlargements 3*a* thereon with openings 3*b* therethrough, into which extend bent ends of the axle 4, which ends are not identified in detail.

The braking wings 3 have braking spurs 3*c* at their free end areas which extend in the braking position of the ski brake 2 downwardly below the running surface of the ski 1. The spurs are slightly curved and tapered at their ends in order to achieve a better engagement with the snow (not illustrated). The enlargements 3*a* of the braking wings 3 are constructed as shoulders which extend approximately perpendicular with respect to the longitudinal axis of the braking wings an form in the braking position of the ski brake 2 with the bent ends of the axle 4 an approximately right angle (FIG. 1). The braking wings 3 are bent three times at the ends which are remote from the braking spurs 3*c*. The first two bent sections 3*d* extend substantially at a right angle with respect to the longitudinal axis of the ski and each have subsequently one further bent section 3*e*, which project from the plane of the braking wings 3 defined by the sections 3*d* and 3*e* and form substantially a right angle with the first bent section 3*d*. The two second bent sections 3*e* are each received in one of the grooves 9 which are arranged on the underside 5*a* of a hollow pedal 5 and are guided in the grooves and are each secured against removal therefrom by means of one further bent section 3*f*.

The pedal 5 is pivotally arranged on a ski-fixed mounting bracket 6, the axis of rotation 7 of which extends at a right angle with respect to the longitudinal axis of the ski. The two slots 9 which are provided on the underside 5*a* of the pedal 5 have two segments 9A and 9B, one of which extends parallel with respect to the longitudinal axis of the ski up to a length which will yet have to be given more exactly and another segment which is bent outwardly toward the two ski edges. Thus a forced control is created between the pedal 5 and the two braking wings 3, so that during a stepping down onto the pedal 5 the two braking wings 3 are pivoted about the common axle 4 first into a position which lies above the upper surface of the ski 1*a*. After reaching this position which is not separately shown in the drawing, the two second bent sections 3*e* are guided in the outwardly extending segments 9B of the slots 9. The straight segments 9A of the slots 9 are thus determined by the distance which is caused by a swinging of the pedal 5 and the two braking wings 3 through the difference of the two radii or calculated from the holding plate 10 or from the mounting bracket 6 up to the end position of the associated bent section 3*e* in the slot 9. Through this design of the two slots 9, the braking wings 3 are now pivoted about their mountings on the axle 4 (openings in the enlargements 3*a*) approximately parallel with respect to the upper side 1 of the ski, wherein the two braking spurs 3*c* reach a position laterally inside of the two lateral ski edges on the upper side 1*a* of the ski. This position is shown in FIG. 3 and corresponds with the retracted position of the ski brake.

Two spiral springs 8 are arranged in the hollow inside of the pedal 5, which springs bias the pedal 5 so that it is urged to swing into the braking position (FIGS. 1 and 2). The two springs 8 are suspended at each one of their ends of the axis of rotation 7 on the mounting bracket 6 of the pedal 5 and at their two other ends on the two third bent sections 3*f* of the two braking wings 3. The pedal 5 is supported at its end which is associated with the mounting bracket 6 on each laterally positioned and upright tabs 5*b*. The tabs 5*b* have rounded-off upwardly facing edge portions which extend coaxially with the axis of rotation 7, which rounded-off edge portions assure an unhindered pivoting of the pedal 5 about the axis of rotation 7.

Figure 4:
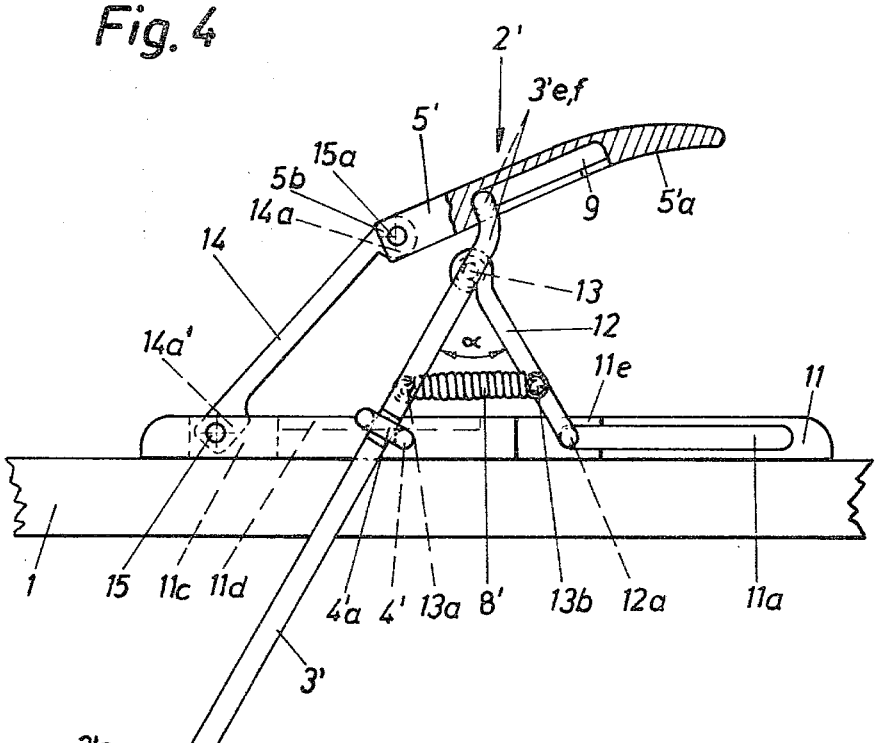
Figure 5:
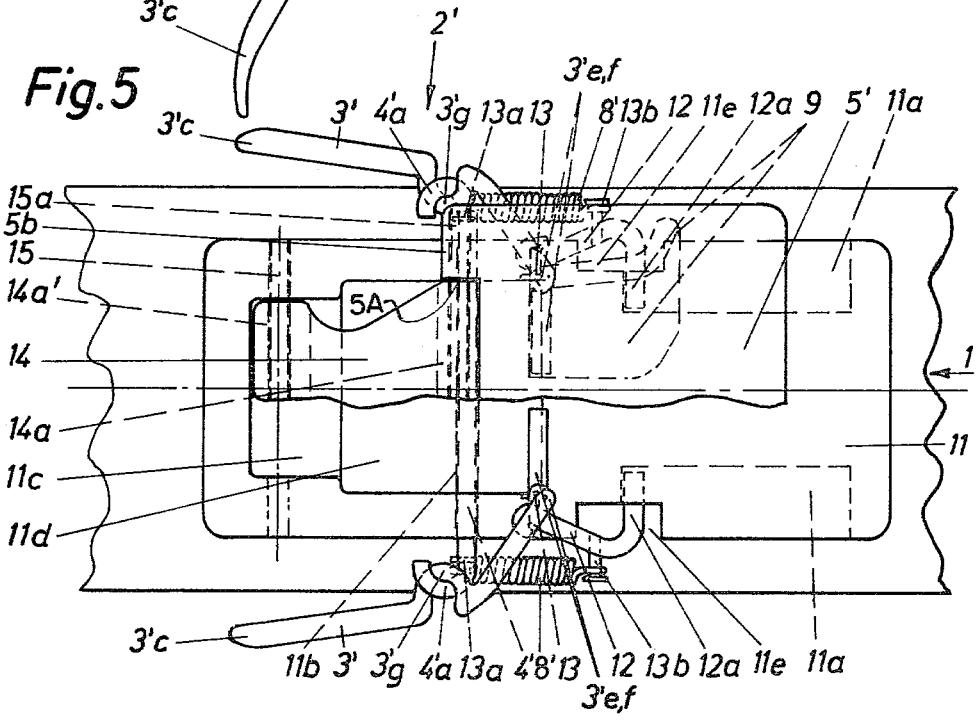
Figure 6:
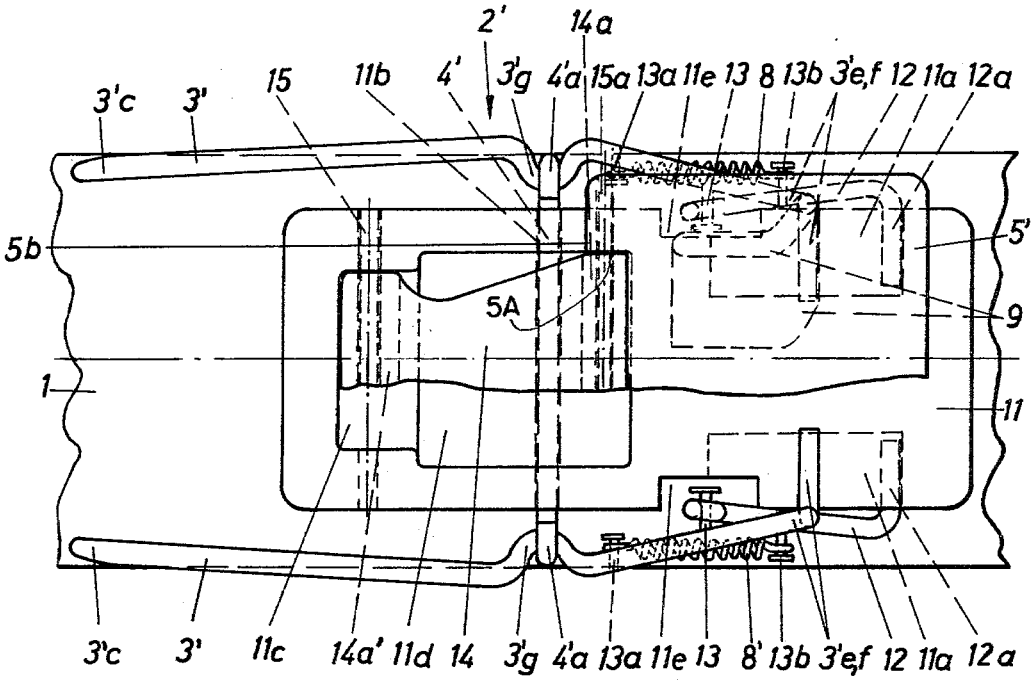

In the exemplary embodiment according to FIGS. 4 to 6, a holding plate 11 with an inventive ski brake 2′ is mounted on a ski 1. The ski brake 2′ consists substantially of two braking wings 3′, of two spiral springs 8′, of one pedal 5′, of one axle 4′ which connects the two braking wings 3′, of two guide members 12 and of one connecting piece 14. The axle 4′ is a wire, which extends substantially at a right angle with respect to the longitudinal axis of the ski. The axle 4′ is supported in an opening 11b, this axis of which extends perpendicularly with respect to the longitudinal axis of the ski and serves as holder, is approximately in the longitudinal center of the holding plate 11, and has an open eyelet 4′*a* at each of the two ends thereof. The longitudinal extent of the axle 4′ extends through the holding plate 11 within the opening 11*b* and grips around each of the braking wings 3′ by means of the two eyelets 4′*a*. The braking wings have in this area an approximately semicircular conventional bend 3′*g*. The axle 4′ is slightly pivotally supported about its own longitudinal axis in the holding plate 11.

The holding plate 11 has adjacent its end which is closest to the tip of the ski an upwardly opening recess 11*c* which extends therethrough and which is substantially rectangular in shape. The recess 11*c* is constructed such that in the holding plate 11 sufficient material remains on the lateral sides thereof in order to support an axle 15 which will be described in more detail later on. A rectangular upwardly opening cavity 11*d* is positioned immediately behind the recess 11*c*, which cavity is slightly wider and approximately twice as long as the recess 11*c*, and is also centrally disposed with respect to the upper side of the holding plate 11.

The depth of the cavity 11*d* corresponds approximately with one third of the thickness of the holding plate 11. The cavity 11*c* and axle 15 are used for supporting or receiving a connecting piece 14 which is yet to be described in detail. The holding plate 11 has on each of its sides a notch 11*e* which are rectangular in shape in a top view and are constructed approximately starting in the center of the longitudinal extent of the holding plate 11 and extend in direction toward the tail of the ski. Furthermore a blind groove 11*a* is constructed in each of the sidewalls of the holding plate 11 and extend, viewed in elevational direction, approximately starting from the center of the notch 11*e* toward the rear end of the holding plae, which end faces the tail of the ski. Bent segments 12*a* of two guides 12 are received in the two blind grooves 11*a*.

The ends of the guide members 12, which are remote from the individual bent sections 12*a* each encircle a pin 13 which has a head thereon and which project substantially perpendicularly from the part of the braking wing 3′ which faces the pedal 5′ toward the center of the ski. Furthermore, fastening pins 13*a*, 13*b* which also have a head thereon are arranged on both of the individual braking wings 3′ and also on the guide members 12, which pins extend substantially perpendicular with respect to the individual holding means (braking wing 3′ or guide members 12) and are each used to support one end of the spiral springs 8′ which are arranged thereon. The spiral springs 8′ urge the braking wings 3′ and the guide members 12 to the braking position, illustrated in FIGS. 4 and 5.

The ends of the two braking wings 3' which are remote from the braking spurs 3'c are bent twice. Each first bent section 3'd extends substantially vertically into an approximately L-shaped slot 9' in a pedal 5', which slot 9' opens outwardly toward the lateral edges of the ski, at the end thereof which is remote from the connecting piece 14, in which slot 9' every braking wing 3' is held against falling out by each second bent section 3'e.

The pedal 5' is a substantially rectangular plate, which is approximately wider than, approximately half as long as and approximately as thick as the holding plate 11. The pedal 5' is bent slightly toward the upper surface 1a of the ski at its end which faces the tail of the ski. It has at its underside 5' a the already mentioned L-shaped slots 9. The end of the pedal 5' facing the tip of the ski has a notch 5A therein defining laterally spaced projections 5b and receives therein one end of a connecting plate 14. The two structural parts (5' and 14) are hingedly connected to one another by means of an axle 15a, which extends through both the projections 5b of the pedal 5 and also the end of the connecting piece 14 and at a right angle with respect to the longitudinal axis of the ski. The connecting piece 14 has in the area of its two ends enlargements 14a and 14a' which extend perpendicularly with respect to the longitudinal axis of the ski. The axle 15a extends through one of the enlargements 14a. The connecting plate 14 is hingedly supported also by means of an axle 15 at the end which faces the tip of the ski, which axle 15 extends perpendicularly with respect to the longitudinal axis of the ski and through both the enlargement 14a' and also the holding plate 11 in the area of the recess 11c and thus also here permits a pivoting movement.

FIG. 6 illustrates the inventive ski brake 2' in the downhill or ready position, similar to FIG. 3 of the first exemplary embodiment. In this position, the braking wings 3' and the guide members 12 are spaced apart and the two springs 8' are strongly tensioned. The two ends of the guide members 12 which grip around the pin 13, move thereby into the notch 11e of the holding plate 11 provided for this purpose.

Upon removal of the ski boot which holds down the ski brake 2', be it released arbitrarily due to removal of the ski or due to a fall, the pedal 5' is released which causes the force of the two spiral springs 8' to become effective and the two braking wings 3' are placed into the braking position which is shown in FIGS. 4 and 5.

Important to the invention in this embodiment is the design of the axle 4', the design of the ski brake 2' and the cooperation of the guide members 12 which at the one end slide in the two blind grooves 11a of the holding plate and the two times bent ends 3'd, 3'e of the two braking wings 3', which at the other end slide in the two L-shaped grooves 9', which structural parts are reciprocally loaded through the common spiral springs 8', and the connecting piece 14 which pivotally connects the pedal 5' to the holding plate 11.

It is understood that during a stepping into the (not illustrated) binding, the pedal 5' which is pushed down by the ski boot spreads apart the two braking wings 3' at the one end and the two guide members 12 at the other end against the force of the two spiral springs 8', after which the ski brake 2' assumes the position illustrated in FIG. 6.

Figure 7:
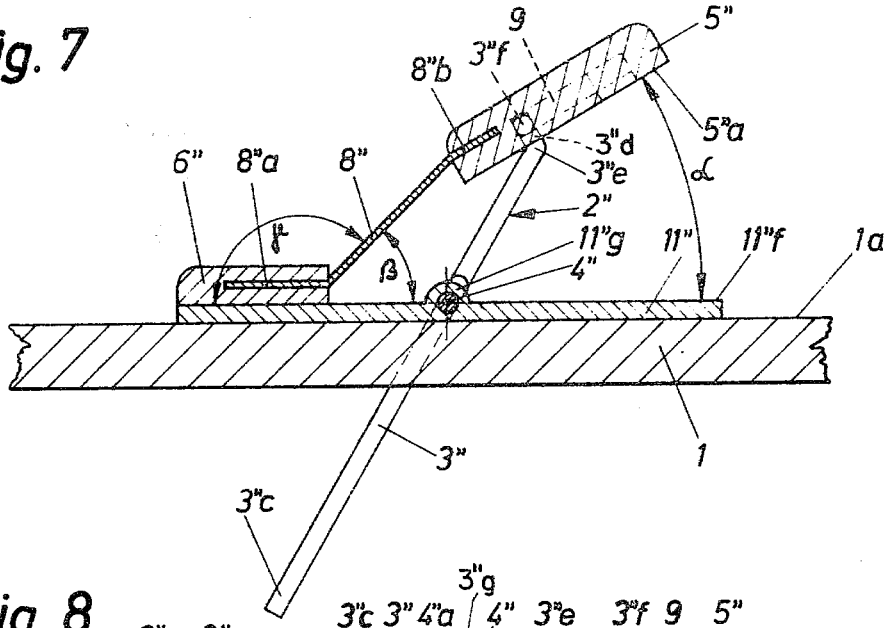
FIG. 7 is a cross-sectional view taken along the line VII—VII of FIG. 8.
Figure 8:
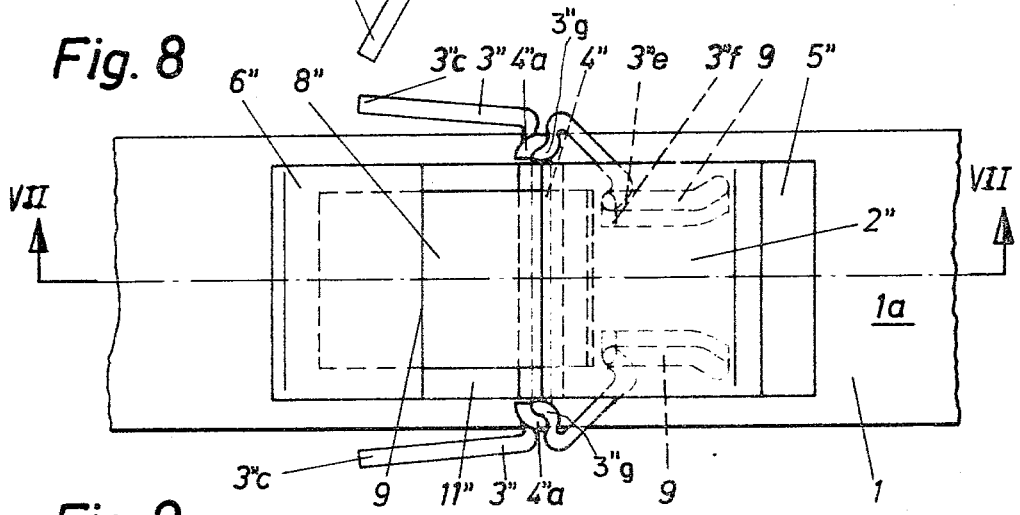
FIG. 8 is a top view of FIG. 7, both in the braking position of the ski brake.
Figure 9:
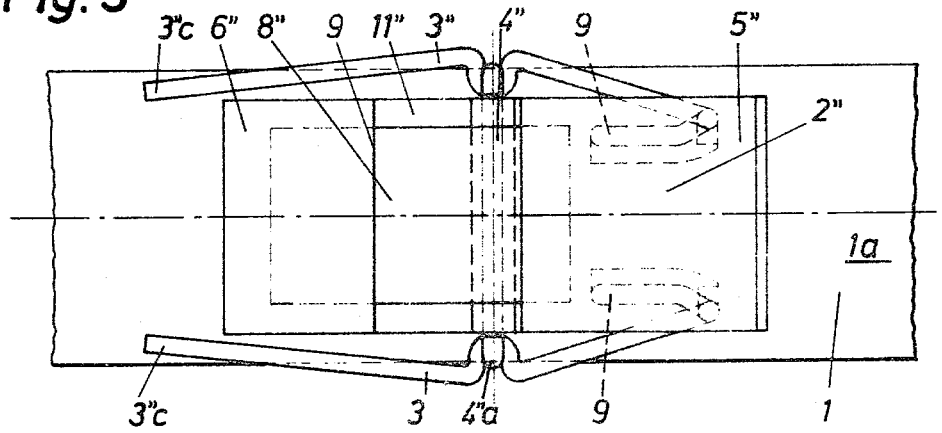
FIG. 9 is a top view in the retracted position of the ski brake.

In the exemplary embodiment according to FIGS. 7 to 9, the holding plate 11" with an inventive ski brake 2" can be recognized on the upper surface 1a of the ski 1. The ski brake 2" consists substantially of two braking wings 3", of one leaf spring 8" and of one pedal 5" which interconnects these two structural parts, and of an axle 4" which supports the two braking wings 3". The axle 4" is a wire, which extends substantially at a right angle with respect to the longitudinal axis of the ski, is supported in a thick part 11"g of the holding plate 11", which thick part extends perpendicularly with respect to the longitudinal axis of the ski, and has at each end an open eyelet 4"a. The axle 4" grips with its longitudinal extent under the holding plate 11" within the approximately semicircular thick part 11"g and grips by means of the eyelets 4"a around each one of the braking wings 3", which have in this area an approximately three-quarter circularly shaped bent segment 3"g. The axle 4" is supported for a limited pivoting about its own longitudinal axis in the holding plate 11". The opening of the eyelet 4"a is smaller than the wire thickness of the braking wings 3".

According to this exemplary embodiment, a fastening plate 6" is arranged on the holding plate 11" and is used to receive one end of a leaf spring and thus acts for same as a kind of a bearing. The other end of the leaf spring 8" is secured to the pedal 5" through an angle $\alpha$ in the range of 15° to 60°, preferably 30° to 45° relative to the upper surface of the ski. As can particularly be recognized from FIG. 7, the two ends of the leaf spring 8" are inserted into the fastening plate 6" or into the pedal 5". Adjacent the location where the leaf spring exits from the fastening plate 6", the leaf spring 8" is bent at an angle $\beta$ which is approximately 45° relative to the upper surface of the ski. This causes the leaf spring 8", when the ski brake 3" is not loaded by any ski boot, to spring upwardly and swing the pedal 5" into the position shown in FIG. 7. The two braking wings 3" are thereby carried along by the pedal 5", so that the desired braking effect is achieved. Braking spurs 3"c dig hereby into the (not illustrated) snow. The two braking wings 3" are carried along by the pedal 5" in that they have at each of their ends a duplicate bent section. The first one of said bent sections 3"d projects thereby substantially vertically into a slot 9 having a substantially L-shaped cross section in the pedal 5" and the second bent section 3"f forms substantially a right angle with the first bent section 3"d. As a result, a secure holding of the braking wings 3" which are associated with the respective slot 9 is achieved.

This construction permits furthermore a pulling of the braking spurs 3"c according to FIG. 9 into the ready position of the ski brake 3" above the upper side 1a of the ski, in that the ends of the slot 9 which are remote from the axle 4" extend viewed from the longitudinal axis of the ski (outwardly) toward the two edges of the ski.

Figure 10:
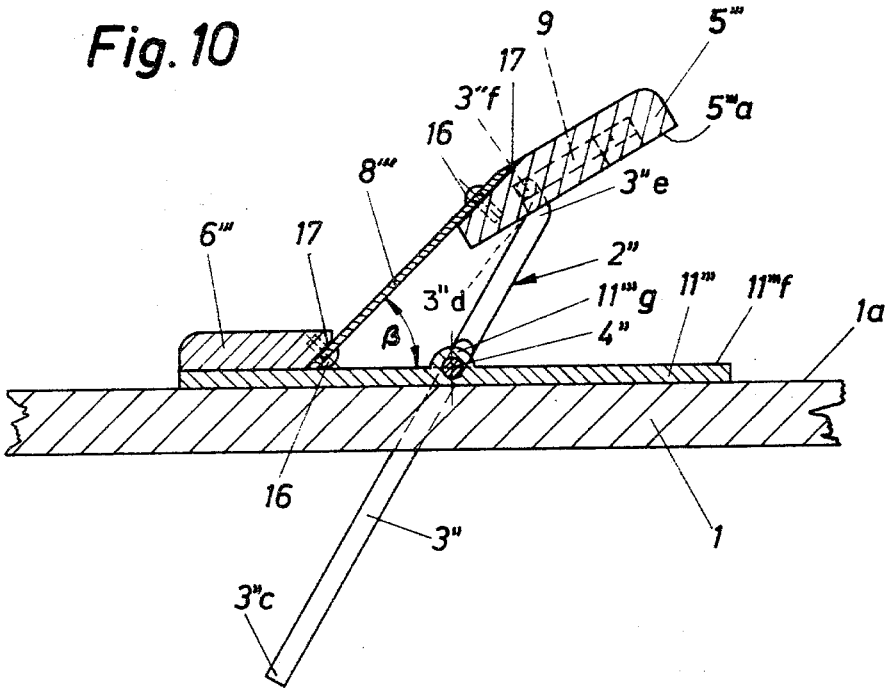
FIG. 10 is a modification of the control of the embodiment according to FIG. 7.

In the embodiment according to FIG. 10, the leaf spring 8" is secured bend-free to the fastening plate 6"' and to the pedal 5"'. The present exemplary embodiment uses rivets 16 for such fastenings. This embodiment is distinguishable from the preceding exemplary embodiment by the simpler design of the leaf spring. For a bend-free arrangement of the leaf spring 8"' on the fastening plate 6"' or on the pedal 5"', the associated surfaces of these structural parts are sloped corresponding with the bend-free extent of the leaf spring 8"'.

The invention is not to be limited to the illustrated and described exemplary embodiments. Further modifications are possible without departing from the scope of the invention. For example, the pedal according to the first exemplary embodiment could be hinged to the holding plate through a connecting piece according to the second exemplary embodiment. It is also conceivable to design the holding plate of the second exemplary embodiment so much more narrow that the construction of separate recesses for receiving the ends of the guide members in the stepped-down condition of the ski brake is not required. In particular in this case it may be purposeful to secure the free ends of the bent sections of the two guide members against a shifting at a right angle with respect to the longitudinal axis of the ski for example through a guideway or an additional bent section.

Modifications with respect to the third exemplary embodiment are also conceivable. It has already been mentioned that the type of fastening of the leaf spring to fastening plate or to the pedal may differ from the described embodiment; various combinations are also conceivable. However, it is also conceivable to design the leaf spring moving on in the area of the fastening plate and/or in the area of the pedal and to associate parts of the fastening plate or of the pedal with the spring. A possible modification exists hereby namely to construct the slots in the form of a negative of a separate insert. Such an insert can for example be covered with plastic, which does not only reduce the manufacturing expenses but the ends of the braking wings which are associated with the pedal and received in the slots to form a guideway with a small friction.

The embodiments of the invention in which an exclusive property or privilege is claimed are defined as follows:

1. A ski brake for use on a ski, comprising:

mounting means adapted to be mounted to said ski;

pedal means and first pivot support means for pivotally securing said pedal means to said mounting means for movement about a first axis perpendicular to the longitudinal axis of said ski between an upright first position and a second position generally parallel to the under surface of said ski, said pedal means at an end thereof remote from said first pivot support means having a pair of laterally spaced guideways opening outwardly in a bottom surface thereof opposing the upper surface of said ski, said guideways each having at least a pair of angled segments, a first segment of said pair of segments extending in a plane parallel to the longitudinal axis of said ski and a second segment of said pair of segments extending transversely to said longitudinal axis of said ski;

a pair of ski brake arms and second pivot support means for pivotally securing said pair of ski brake arms to said mounting means for movement about a second axis extending parallel to said first axis between a braking position and a retracted position and a third axis orthogonally related to said second axis, each of said ski brake arms having at a first end thereof means adapted to engage the snow and at a second end thereof guide means received in a respective one of said pair of guideways, said second pivot support means being located intermediate said first and second ends, each of said guide means comprising at least one elongated segment extending transversely of the longitudinal extent of said ski brake arm and being slidingly disposed in said first and second segments of said guideway;

means for preventing a separation, during use, of each of said ski brake arms from said guideways in said pedal means; and resilient means for continually urging said pedal means to said upright first position, the fixed spacing between said first and second pivot support means causing, when said pedal means is in said upright position, said elongated segment on each of said ski brake arms to be located in said first segment of each of said guideways and said first ends of each of said ski brake arms to project below the bottom surface of said ski, a movement of said pedal means against the urging of said resilient means to said second position causing said elongated segment on each of said ski brake arms to slide from said first segment of each of said guideways into said second segment of each of said guideways to cause a positioning of said first ends of each of said ski brake arms over said upper surface of said ski.

2. The ski brake according to claim 1, wherein said pair of laterally spaced guideways are equally spaced from the longitudinal center axis of said mounting means and on opposite sides thereof and wherein said second segments of each of said guideways is angled laterally outwardly from said first segments thereof.

3. The ski brake according to claim 2, wherein said first segment of each of said guideways is straight and wherein the length of said straight first segments corresponds at least with the horizontal difference in length in a direction parallel to said upper surface of said ski between the portion of said ski brake arms between said second pivot support means and said elongated segment when said pedal means is in said first position thereof and said portion when said pedal means is in said second position thereof.

4. The ski brake according to claim 1, wherein each of said ski brake arms includes enlargements at the location of said second pivot support means, said second pivot support means including an axle rotatably mounted on said mounting means about said second axis with the end segments of said axle each being angled at a right angle to said second axis, said enlargements being pivotally secured to said right angled end segments of said axle for movement about said third axis.

5. The ski brake according to claim 4, wherein each of said guide means includes three angularly related segments, a first segment extending substantially at a right angle with respect to the longitudinal axis of said ski, a second segment corresponding to said elongated segment extending out of the plane defined by said longitudinal extent of said ski brake arm and said first segment substantially perpendicularly with respect to the bottom surface on said pedal means and a third segment extending parallel with respect to said first segment.

6. The ski brake according to claim 5, wherein said resilient means includes a pair of springs, one end of each of said springs being connected to said third segments and the other end thereof being connected to said first pivot support means and wherein said two springs are housed in means defining a cavity in said pedal means.

7. The ski brake according to claim 1, wherein said second pivot support means is defined by a pair of open eyelet means at opposite ends of an axle extending perpendicular to said longitudinal axis of said ski and being rotatable about said second axis, and an approximately semicircular segment on each of said ski brake arms received in the respective one of said open eyelet means to thereby define a bearing rendering said ski brake arms pivotal about said third pivot axis.

8. The ski brake according to claim 1, wherein said mounting means includes an elongated, laterally outwardly opening blind groove on opposite lateral sides of said mounting means and symmetrically oriented relative to the longitudinal center of said ski and including a pair of guide members each connected at one end to one of said ski brake arms intermediate said second pivot support means and said elongated segment, the other ends thereof each being received in one of said blind grooves to serve as a guide for said ski brake arms in the longitudinal direction of said ski.

9. The ski brake according to claim 8, wherein both on said ski brake arms intermediate said second pivot support means and said guide means and also on said guide members fastening pins are arranged, the axes of which extend substantially perpendicularly with respect to the structural parts to which they are attached, said fastening pins having connected thereto and extending therebetween a spring defining said resilient means effectig an urging of said ski brake arms and said guide members in a closing direction toward one another.

10. The ski brake according to claim 1, wherein said pedal means includes a pedal and a connecting piece hingedly connected to said pedal by a connecting axle extending through both said connecting piece and also said pedal substantially at a right angle with respect to said longitudinal axis of the ski, said connecting piece being pivotally secured to said mounting means by said first pivot support means and wherein said guideways are provided in said pedal.

11. The ski brake according to claim 1, wherein said pedal means is connected to said mounting means by a leaf spring defining said resilient means, said first pivot support means being defined by a flexural location on said leaf spring and adjacent said mounting means whereat said leaf spring is flexed when said pedal means is moved toward and away from said second position, said leaf spring being tensioned in said retracted position of said ski brake arms and relaxed in said braking position.

12. The ski brake according to claim 11, wherein the underside of said pedal means defines in said braking position of said ski brake arms with said upper surface of said ski an angle ($\alpha$) in the range of 15° to 60°.

13. The ski brake according to claim 12, wherein said angle ($\alpha$) is in the range of 30° to 45°.

14. The ski brake according to claim 12, wherein said mounting means is a fastening plate having a first sloped surface thereon, wherein said leaf spring is fastened to said fastening plate at said first sloped surface and wherein the angle ($\beta$) that said leaf spring makes with said upper surface of said ski is larger than said angle ($\alpha$).

15. The ski brake according to claim 14, wherein said pedal means has a second sloped surface and wherein said leaf spring is fastened to said pedal means at said second sloped surface.

16. The ski brake according to claim 11, wherein said mounting means is a fastening plate, wherein said leaf spring has at least in the region of said fastening plate a bend at an angle ($\beta$) relative to said upper surface of said ski, said angle ($\beta$) being larger than said angle ($\beta$).

17. The ski brake according to claim 16, wherein said angle ($\beta$) is 45°.

* * * * *

UNITED STATES PATENT OFFICE

CERTIFICATE OF CORRECTION

Patent No. 4 234 206 Dated November 18, 1980

Inventor(s) Rupert Hofbauer et al

It is certified that error appears in the above-identified patent and that said Letters Patent are hereby corrected as shown below:

Column 13, Line 22; change "fectig" to ---fecting---.

Column 14, Line 31; change "(β)" (last occurrence) to ---(α)---.

Signed and Sealed this

*Third* Day of *March 1981*

[SEAL]

*Attest:*

RENE D. TEGTMEYER

*Attesting Officer*

*Acting Commissioner of Patents and Trademarks*